US008302824B2

(12) United States Patent
Brannon et al.

(10) Patent No.: US 8,302,824 B2
(45) **Date of Patent: *Nov. 6, 2012**

(54) DISPENSING CLOSURE HAVING A FLOW CONDUIT WITH KEY-HOLE SHAPE

(75) Inventors: Patrick J Brannon, Warwick, RI (US); Clifford W. Skillin, Blackstone, MA (US); Sergey Romanov, Cranston, RI (US)

(73) Assignee: Polytop LLC, Slatersville, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/769,607

(22) Filed: Apr. 28, 2010

(65) Prior Publication Data

US 2010/0206916 A1 Aug. 19, 2010

(51) Int. Cl.
*B65D 47/00* (2006.01)
*B65D 39/00* (2006.01)
*B65D 43/18* (2006.01)

(52) U.S. Cl. ..... 222/547; 222/564; 222/575; 222/556; 215/235; 220/259.1; 220/375; 220/837

(58) Field of Classification Search ..... 222/547, 222/556, 571, 562, 546, 564, 563, 575, 477, 222/519, 520, 521, 454, 456; 215/235, 330, 215/237, 256, 306, 254; 220/254.1, 258.1, 220/259.1, 375, 837
See application file for complete search history.

(56) References Cited

U.S. PATENT DOCUMENTS

| | | | |
|---|---|---|---|
| 330,545 | A | 11/1885 | Barker |
| 1,844,442 | A | 2/1932 | Schmalz |
| 2,130,749 | A | 9/1938 | Von Till |
| 2,313,031 | A | 3/1943 | Parkhurtst |
| 2,921,724 | A | 1/1960 | Whitney |
| 3,055,526 | A | 9/1962 | Plunkett |
| 3,289,885 | A | 12/1966 | Villaveces |
| 3,353,725 | A | 11/1967 | Caceres |
| 3,439,843 | A | 4/1969 | Corsette |

(Continued)

FOREIGN PATENT DOCUMENTS

| | | |
|---|---|---|
| DE | 4214548 | 11/1993 |

(Continued)

OTHER PUBLICATIONS

PCT Notification of Transmittal of International Search Report and the Written Opinion of the International Searching Authority, or the Declaration for International Application No. PCT/US07/77520.

(Continued)

*Primary Examiner* — Kevin P Shaver
*Assistant Examiner* — Stephanie E Williams
(74) *Attorney, Agent, or Firm* — Barlow, Josephs & Holmes, Ltd.

(57) ABSTRACT

A dispensing closure has a flow conduit that provides a sufficient flow restriction to prevent unwanted spurting of the product when the container is initially opened. The dispensing closure includes a closure body with an upper deck and a flow conduit extending through the upper deck. The flow conduit includes an entry orifice having an entrance axis and an exit orifice having an exit axis. The entrance axis is parallel to, but not co-linear with, the exit axis to provide a non-linear flow path from an interior of the closure to the exterior of the closure.

14 Claims, 3 Drawing Sheets

U.S. PATENT DOCUMENTS

| | | | |
|---|---|---|---|
| 3,618,170 | A | 11/1971 | Owens |
| 3,690,496 | A | 9/1972 | Gibson |
| 3,693,847 | A | 9/1972 | Gibson |
| 3,734,332 | A | 5/1973 | Grulich |
| 3,784,045 | A | 1/1974 | Komendowski |
| 3,827,593 | A | 8/1974 | Kramb et al. |
| 3,877,598 | A | 4/1975 | Hazard |
| 3,980,211 | A | 9/1976 | Owens |
| 4,209,485 | A | 6/1980 | Greenspan |
| 4,241,855 | A | 12/1980 | Yoshioka |
| 4,343,754 | A | 8/1982 | Wilde et al. |
| 4,487,342 | A | 12/1984 | Shy |
| 4,564,113 | A | 1/1986 | Mendler |
| 4,579,241 | A | 4/1986 | Hayes |
| 4,649,013 | A | 3/1987 | Yamamoto et al. |
| 4,749,108 | A | 6/1988 | Dornsbusch et al. |
| 4,767,587 | A | 8/1988 | Towns et al. |
| 4,778,071 | A | 10/1988 | Fillmore |
| 4,782,985 | A | 11/1988 | Kinsley |
| 4,880,140 | A | 11/1989 | Solomon et al. |
| 4,949,880 | A | 8/1990 | Badley |
| 5,033,655 | A | 7/1991 | Brown |
| 5,048,723 | A | 9/1991 | Seymour |
| 5,123,575 | A | 6/1992 | Li |
| 5,197,634 | A | 3/1993 | Beck |
| 5,271,531 | A | 12/1993 | Rohr et al. |
| 5,277,318 | A | 1/1994 | Smalley, Jr. et al. |
| 5,285,913 | A | 2/1994 | Morton |
| 5,292,020 | A | 3/1994 | Narin |
| 5,332,131 | A | 7/1994 | Pehr |
| 5,370,284 | A | 12/1994 | Dirksing |
| 5,472,122 | A | 12/1995 | Appleby |
| 5,509,582 | A | 4/1996 | Robbins, III |
| 5,512,228 | A | 4/1996 | Adams et al. |
| 5,518,152 | A | 5/1996 | Burcham et al. |
| 5,547,091 | A | 8/1996 | Neveras et al. |
| 5,779,110 | A | 7/1998 | Brown et al. |
| 5,819,994 | A | 10/1998 | Leipold |
| 5,820,807 | A | 10/1998 | Urmston |
| 5,875,909 | A | 3/1999 | Guglielmini |
| 5,992,659 | A | 11/1999 | Nofer et al. |
| 6,006,960 | A | 12/1999 | Gross |
| 6,029,861 | A | 2/2000 | Gier |
| 6,412,664 | B1 | 7/2002 | Wolff et al. |
| 6,454,130 | B1 | 9/2002 | Miller et al. |
| 6,523,720 | B1 | 2/2003 | Robbins, III |
| 6,564,978 | B1 | 5/2003 | Safian et al. |
| 6,609,694 | B2 | 8/2003 | Francois et al. |
| 6,644,620 | B2 | 11/2003 | Johnson |
| 6,685,041 | B1 | 2/2004 | Geisinger |
| 6,837,402 | B2 | 1/2005 | Cardia |
| 7,014,075 | B2 | 3/2006 | Bonifacio et al. |
| 7,637,402 | B2 * | 12/2009 | Romanov et al. ..... 222/547 |
| 7,735,699 | B2 * | 6/2010 | Brannon et al. ..... 222/547 |
| 2004/0079766 | A1 | 4/2004 | Kokubo |
| 2004/0245290 | A1 | 12/2004 | Hagihara |
| 2005/0072788 | A1 | 4/2005 | Lieberman et al. |
| 2005/0167455 | A1 | 8/2005 | Yim |
| 2006/0175357 | A1 | 8/2006 | Hammond |

FOREIGN PATENT DOCUMENTS

| | | | |
|---|---|---|---|
| EP | 0199673 | A2 | 10/1986 |
| EP | 0541846 | A1 | 5/1993 |
| JP | 2004001836 | | 1/2004 |
| WO | 9303338 | A1 | 2/1993 |
| WO | 9513220 | | 5/1995 |
| WO | 0198162 | A1 | 12/2001 |
| WO | 02074650 | A1 | 9/2002 |

OTHER PUBLICATIONS

PCT International Search Report for International Application No. PCT/US07/77520.

PCT Written Opinion for International Application No. PCT/US07/77520.

International PCT Application No. PCT/US07/77551 Transmittal.

International PCT Application No. PCT/US07/77551 International Search Report.

International PCT Application No. PCT/US07/77551 Written Opinion.

* cited by examiner

DISPENSING CLOSURE HAVING A FLOW CONDUIT WITH KEY-HOLE SHAPE

CROSS REFERENCE TO RELATED APPLICATIONS

This application is related to and claims priority from earlier filed U.S. Non-Provisional patent application Ser. No. 11/849,979 filed Sep. 4, 2007, now U.S. Pat. No. 7,735,699, earlier filed U.S. Provisional Patent Application No. 60/893,883 filed Mar. 8, 2007 and U.S. Provisional Patent Application No. 60/824,322 filed Sep. 1, 2006, all of which are incorporated herein by reference.

BACKGROUND OF THE INVENTION

The present invention relates to container closures, and more particularly to squeeze-type container dispensing closures.

There are two major trends occurring in the design of dispensing containers and closures. The first trend is a focus on providing a "clean pour" during dispensing of the product. Many food products, such as mustard and ketchup, have a high viscosity and require the user to tip the container, shake down the product and then squeeze the container to dispense the product. Past dispensing closures tended to leak product onto the top deck of the closure after dispensing, creating a messy appearance and often requiring cleaning to reseal the closure. The current emphasis in "clean pour" design is on preventing spurting of the product when the container is inverted to the dispensing position and/or shaken down, and creating a "suck-back" effect as pressure is released from the container to draw the product back into the closure.

A second trend is a growing number of dispensing containers and closures being designed so that they can be stored in an inverted position, i.e. cap down. In this regard, the product is always located right at the dispensing closure for easy dispensing right from storage. This reduces the need to tip and shake the container to push the product down to the dispensing closure. There is a balance however, between having the product at the closure for dispensing and the need to prevent the product from immediately spurting out once the lid of the closure is opened.

Both of these trends have resulted in the design of dispensing closures having various types of valve structures that facilitate both a clean pour and inverted storage. For example, a silicone valve structure is illustrated and described in U.S. Pat. No. 5,271,531. While these silicone valves have been widely accepted by both the manufacturers and the consumers, they are somewhat more difficult to manufacture, as they require several inter-fitting parts, and thus they tend to be more expensive than traditional one-piece dispensing closures.

Another perceived drawback to the silicone valve closure is that they are constructed out of two different types of plastic and thus, from a recycling standpoint, they are more difficult to recycle because the silicone valve must be separated from the plastic closure body for recycling. While this is not a major issue in the United States, at least yet, it is currently a major issue in Europe where recycling is extremely important and even mandated in some countries.

Other designs of dispensing closures focus on the use of interior partitions to slow the flow of the product exiting the dispensing orifice. For example, U.S. Pat. No. 5,123,575 discloses a design of a dispensing closure having multiple chambers. This patent discloses a container for motor oil with three interior chambers, namely a primary chamber between the first partition and the bottom wall, a secondary partition between the first and second partitions and a tertiary chamber between the top wall and the second partition. While the concept of the design may provide the desired flow characteristics, the design is virtually impossible to mold using conventional injection molding or blow molding techniques and thus is not commercially feasible.

U.S. Pat. No. 5,819,994 also discloses a dispensing closure using multiple chambers. This patent discloses a flow controlling cap for a fluid (water) container that controls fluid flow by means of gravity and pressure, and has a first chamber formed by a first hollow cylinder and a second chamber formed by a second hollow cylinder having a greater diameter than the first hollow cylinder. While the circuitous path of this design is effective for water, the flow characteristics of water are different than other viscous fluids and thus the design is not believed to be suited for other more viscous products. In short, it would be difficult to force viscous fluids through the multi-chamber design.

Accordingly, there exists a need in the industry for a one-piece dispensing closure that provides a "clean pour" and prevents premature flowing of viscous product prior to squeezing the dispensing container. In addition, there exists a need a design of a dispensing closure that is easy to mold and made of one type of recyclable plastic.

SUMMARY OF THE INVENTION

The present invention preserves the advantages of existing dispensing closures while providing new advantages not found in currently available dispensing closures and overcoming many disadvantages of such currently available dispensing closures. The general concept of the present invention is to provide a non-linear flow path from an interior of the dispensing closure to an exterior of the dispensing closure so that the product does not immediately spurt out upon opening of the closure lid and/or inverting and shaking the container to move the product toward the dispensing orifice.

Generally, the dispensing closure comprises a closure body, a closure lid and a living hinge structure hingeably connecting the closure lid to the closure body. The closure body has an upper deck and a skirt depending from the upper deck where the skirt is configured and arranged to mount to a product container (not shown). Preferably, the product container is a conventional squeeze-type container. Preferably, the skirt is internally threaded for threaded mounting on a product container.

A flow conduit extends through the upper deck for the passage of a viscous product, such as mustard. The flow conduit includes an entry orifice (inside the container) having an entrance axis and an exit orifice (outside the container) having an exit axis. The entrance axis is parallel to, but not co-linear with the exit axis to provide a non-linear flow path from the interior of the closure to the exterior of the closure. The bottom wall of the flow conduit thus prevents the direct flow of product into the flow conduit along the exit axis.

It is therefore an object of the present invention to provide a one-piece low cost dispensing closure that does not include a valve structure.

It is a further object of the embodiment to provide a dispensing closure having a "clean-pour" dispensing characteristic.

Another object of the embodiment is to provide a dispensing closure having a sufficient flow restriction, to counter product head pressure created when an upright container is quickly inverted and shaken to dispense product.

Another object of the embodiment is to provide an obstructed flow path or a non-linear flow path from an interior of the dispensing closure to an exterior of the dispensing closure.

Another object of the embodiment is to provide a flow conduit that allows product to flow freely upon squeezing while also providing a passive flow restriction.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the dispensing closure are set forth in the appended claims. However, the dispensing closure, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
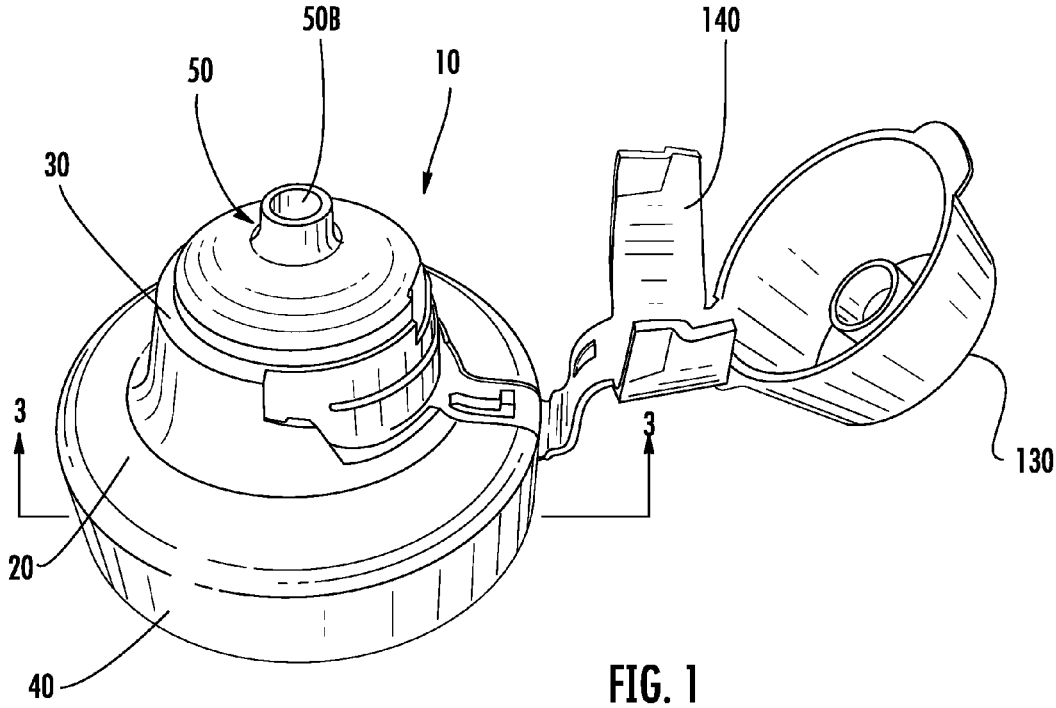
FIG. 1 is a perspective view of the dispensing closure constructed in accordance with the teachings of the present invention.

Referring now to the drawings, the dispensing closure 10 of the instant invention is illustrated in FIGS. 1-4. As will hereinafter be more fully described, the instant dispensing closure 10 includes a unique flow conduit arrangement, which includes an offset, obstructed, and non-linear flow path. The unique arrangement provides anti-spurting in upright containers as well as "suck-back" for cleaner product dispensing, i.e. "clean pour".

Generally, the dispensing closure 10 comprises a closure body 20, a closure lid 130 and a living hinge structure 140 hingeably connecting the closure lid 130 to the closure body 20. The closure body 20 has an upper deck 30 and a skirt 40 depending from the upper deck 30 where the skirt 40 is configured and arranged to mount to a product container (not shown). Preferably, the product container is a conventional squeeze-type container. Preferably, the skirt 40 is internally threaded for threaded mounting on a product container (See FIG. 2). However, it is to be understood that other skirt mounting arrangements are also contemplated within the scope of the invention, and the invention should not be limited to the inwardly threaded skirt as the only means for mounting.

Figure 2:
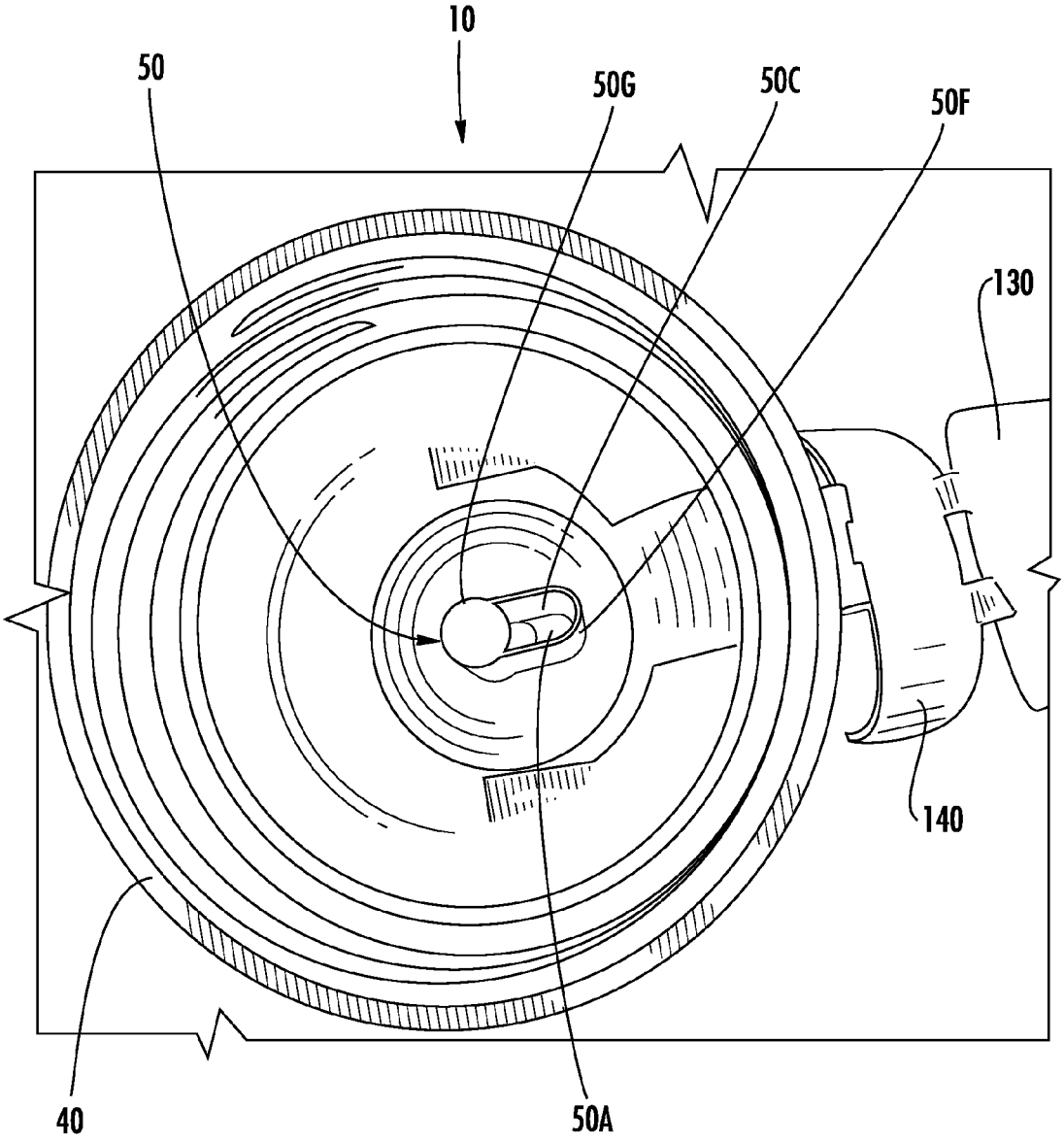
FIG. 2 is a bottom view thereof.
Figure 3:
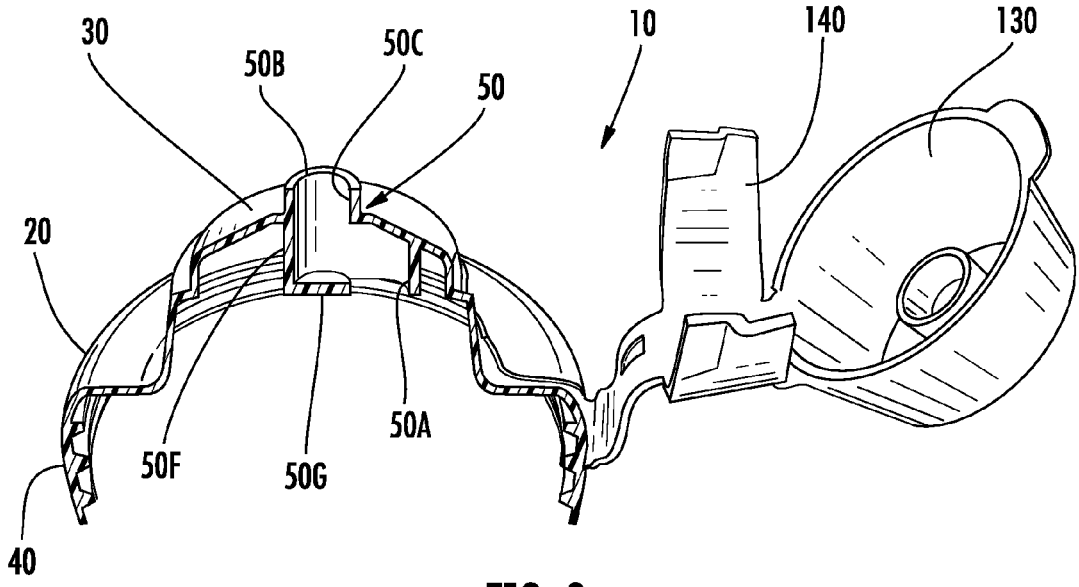
FIG. 3 is a cross-sectional view of thereof as taken along line 3-3 of FIG. 1.
Figure 4:
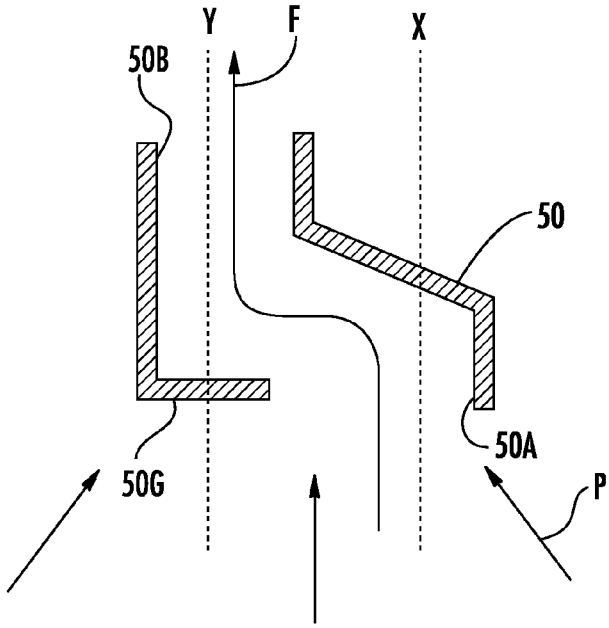
FIG. 4 is a diagrammatical view thereof.

A flow conduit generally indicated at 50 extends through the upper deck 30 for the passage of a viscous product, such as mustard. The flow conduit 50 is generally defined by an interior wall 50C, an exterior wall 50F, and a bottom wall 50G (baffle). The flow conduit 50 includes an entrance orifice 50A (inside the container) having an entrance axis X and an exit orifice 50B (outside the container) having an exit axis Y. Generally, the entrance axis X is offset from the exit axis Y to provide a non-linear flow path (see arrows F) from the interior of the closure 10 to the exterior of the closure. More specifically, the flow conduit 50 is expanded to the side of the exit orifice 50B, and the entrance orifice 50A is located in the bottom wall 50G, but offset from the exit orifice 50B. The entrance axis X is thus parallel to but not co-linear with the exit axis Y. Referring briefly to FIG. 2, it is noted that the overall shape of the flow conduit 50 when viewed from the bottom is a key-hole shape.

The bottom wall 50G of the conduit thus prevents the direct flow of product (see arrows P—FIG. 1A) into the flow conduit along the exit axis Y and acts as a baffle to counter product head pressure created by either storing the product in an inverted condition, or head pressure created when an upright container is quickly inverted to dispense product. Flow of the product is shown by arrow F.

The baffling effect is also enhanced by the passage of the product from the container, through the small entrance orifice 50A and into the interior of the flow conduit 50. The velocity of the product will increase as it travels through the entrance orifice 50A. However, the velocity of the product then decreases as it travels into the larger interior volume of the flow conduit 50 before it leaves through the exit orifice 50B. Spurting thus occurs into the interior of the flow conduit 50 and not directly out of the exit orifice. Accordingly, when the container is inverted, and is rapidly shaken up and down by a user to dispense the product, the product first decelerates into the larger volume interior flow conduit 50, and does not spurt out the exit orifice 50B. When pressure is applied to the squeeze container, the product is then forced out of the exit orifice 50B.

It is to be noted that the dimensions of the flow conduit 50 are adjustable, depending upon the viscosity of the product stored within an interior of the dispensing closure 10. For example, if lower viscosity mustard is contained within the interior of the dispensing closure 10, it may be desirable for the flow conduit 50 to be smaller in size or dimension to achieve a lower flow rate. In the preferred embodiment as shown, the exit orifice 50B is circular, and is somewhat smaller than the entrance orifice 50A.

Based on the disclosure above, the present invention provides a one-piece dispensing closure. Also, the invention provides a one-piece dispensing closure having a "clean-pour" dispensing characteristic. Furthermore, the invention provide a one-piece dispensing closure having a sufficient flow restriction within the flow path to counter product head pressure created when an upright container is quickly inverted and/or shaken to dispense product.

It would be appreciated by those skilled in the art that various changes and modifications can be made to the illustrated embodiments without departing from the spirit of the embodiments. All such modifications and changes are intended to be covered by the appended claims.

What is claimed is:

1. A one-piece dispensing closure for a viscous food condiment comprising:

a closure body; a closure lid; and a living hinge structure hingeably connecting said closure lid to said closure body, said closure body including an upper deck, a skirt depending from the upper deck, said skirt being configured and arranged to mount to a product container; and a flow conduit extending through said upper deck, said flow conduit having a sidewall and a bottom wall, said flow conduit including an entrance orifice in the bottom wall having an entrance axis and an exit orifice having an exit axis, said bottom wall being configured and arranged to prevent the flow of product into the flow conduit along the exit axis, said bottom wall having a surface area proportionally sized to the surface area of the exit orifice to prevent direct flow of product out of exit orifice, said entrance axis being stepped from said exit axis whereby said flow conduit provides a non-linear flow path from an interior of said closure to an exterior of said closure, said entrance axis being parallel to said exit axis, said entrance orifice being larger than said exit orifice, said bottom wall and said sidewall of said flow conduit defining an interior volume when viewed in a cross-section extending perpendicular to the entrance and exit axes, said cross-sectional area of said interior volume being larger than the cross sectional area of said entrance orifice wherein a flow of viscous food condiment through said entrance orifice decelerates into said interior volume of said flow conduit to prevent direct spurting through said exit orifice upon dispensing, said food condiment being dispensed without spurting through said exit orifice upon filling of the interior volume and the application of additional pressure to said food condiment.

2. The dispensing closure of claim 1, wherein said flow conduit has a non-uniform volume extending from the entrance orifice to the exit orifice, said entrance orifice expanding into an interior volume larger than the interior volume of the exit orifice.

3. The dispensing closure of claim 1, wherein said flow conduit has a portion extending above and below said upper deck, said flow conduit portion extending below said upper deck defining a key-hole shape.

4. The dispensing closure of claim 1, wherein said flow conduit has at least two sidewalls positioned along a 90 degree angle depending downwardly from said upper deck, said at least two sidewalls directly opposing one another; and a bottom wall perpendicular to said at least one sidewall.

5. The dispensing closure of claim 1, wherein said flow conduit extends through an opening in said upper deck, said opening is concentric to said surface of said upper deck.

6. The dispensing closure of claim 1, further comprising:

a recess area entirely surrounding an outer surface of said flow conduit extending below said upper deck.

7. The dispensing closure of claim 6, wherein a height of said side wall is about the height of said recess area.

8. The dispensing closure of claim 1, further comprising:

a first and second upper deck, said first upper deck including said opening for exit orifice; and an inner skirt depending from said first upper deck and an outer skirt depending from said second upper deck.

9. The dispensing closure of claim 1, wherein the living hinge structure is a dual living hinge structure comprising:

a first living hinge joining a first end of a hinge body to said outer surface of said skirt, said hinge body being hingeably movable from an open position to a closed position in facing mating relation with said skirt, said hinge body and said skirt including interfitting mating formations to secure said hinge body in facing mating relation with said skirt; and a second living hinge joining a second end of said hinge body to said closure lid, said closure lid being hingeably movable from an open position to a closed position.

10. The dispensing closure of claim 1, wherein the upper deck defines an arcuate shape.

11. A one-piece dispensing closure for a viscous food condiment comprising:

a closure body, said closure body including an upper deck, a skirt depending from the upper deck, said skirt being configured and arranged to mount to a product container;

a flow conduit extending through an opening in said upper deck, said flow conduit including a portion extending above and below said upper deck, said flow conduit has a first wall positioned substantially perpendicular to said upper deck and a second wall positioned substantially perpendicular to said first wall, said flow conduit including an entrance orifice in the second wall having an entrance axis and an exit orifice having an exit axis, said second wall being configured and arranged to prevent the flow of product into the flow conduit along the exit axis, said second wall has a surface area proportionally sized to the surface area of the exit orifice to prevent direct flow of product out of the exit orifice, said entrance axis being stepped from said exit axis whereby said flow conduit provides a non-linear flow path from an interior of said closure to an exterior of said closure, said entrance axis being parallel to said exit axis, said flow conduit portion extending from said upper deck, said second wall and said first wall of said flow conduit defining an interior volume when viewed in a cross-section extending perpendicular to the entrance and exit axes, and said cross-sectional area of said interior volume being larger than the cross-sectional area of said entrance orifice wherein a flow of viscous food condiment through said entrance orifice decelerates into said interior volume of said flow conduit to prevent direct spurting through said exit orifice upon dispensing, said food condiment being dispensed without spurting through said exit orifice upon filling of the interior volume and the application of additional pressure to said food condiment.

12. The dispensing closure of claim 1, wherein said bottom wall and said sidewall of said flow conduit defining an interior volume has a general shape of a key-hole when viewed in a cross-section extending perpendicular to the entrance and exit axes.

13. The dispensing closure of claim 11, wherein said flow conduit portion extending from said upper deck defining a key-hole shape, said second wall and said first wall of said flow conduit defining an interior volume that has the general shape of a key-hole when viewed in a cross-section extending perpendicular to the entrance and exit axes.

14. A dispensing closure for a viscous food condiment comprising:

a closure body; a closure lid; and a hinge structure hingeably connecting said closure lid to said closure body, said closure body including an upper deck, a skirt depending from the upper deck, said skirt being configured and arranged to mount to a product container; and a flow conduit extending through said upper deck, said flow conduit having a sidewall and a bottom wall, said flow conduit including an entrance orifice in the bottom wall having an entrance axis and an exit orifice having an exit axis, said bottom wall being configured and arranged to prevent the flow of product into the flow conduit along the exit axis, said bottom wall having a surface area proportionally sized to the surface area of the exit orifice to prevent direct flow of product out of exit orifice, said entrance axis being stepped from said exit axis whereby said flow conduit provides a non-linear flow path from an interior of said closure to an exterior of said closure, said cross-sectional area of said interior volume being larger than the cross-sectional area of said entrance orifice wherein a flow of viscous food condiment through said entrance orifice decelerates into said interior volume of said flow conduit to prevent direct spurting through said exit orifice upon dispensing, said food condiment being dispensed without spurting through said exit orifice upon filling of the interior volume and the application of additional pressure to said food condiment.

* * * * *